US005934521A

United States Patent [19]

Yamada et al.

[11] Patent Number: 5,934,521

[45] Date of Patent: Aug. 10, 1999

[54] HOT MELT APPLICATOR AND NOZZLE USED THEREFOR

[75] Inventors: Takeo Yamada, Yokohama; Katsuhiko Koike, Hachioji; Norihiro Kuzuu, Sagamihara; Isao Ono, Hachioji; Shozo Yodo, Sagamihara, all of Japan

[73] Assignee: Nireco Corporation, Tokyo, Japan

[21] Appl. No.: 09/144,081

[22] Filed: Aug. 31, 1998

Related U.S. Application Data

[62] Division of application No. 08/796,705, Feb. 6, 1997.

[30] Foreign Application Priority Data

Feb. 16, 1996 [JP] Japan ..... 8-028909
Aug. 9, 1996 [JP] Japan ..... 8-210703

[51] Int. Cl.[6] ..... B67D 5/00

[52] U.S. Cl. ..... 222/504; 222/146.2; 222/518; 222/559; 222/309

[58] Field of Search ..... 222/146.2, 146.4, 222/146.5, 309, 504, 518, 559

[56] References Cited

U.S. PATENT DOCUMENTS

| | | | |
|---|---|---|---|
| 3,420,208 | 1/1969 | Guthrie . | |
| 3,537,653 | 11/1970 | Jones . | |
| 3,622,050 | 11/1971 | Acton et al. | 222/309 |
| 4,320,858 | 3/1982 | Mercer et al. | 222/146.5 |
| 4,465,212 | 8/1984 | Boone | 222/504 |
| 4,651,906 | 3/1987 | Hoffmann et al. | 222/504 |
| 4,941,614 | 7/1990 | Ilott . | |
| 5,277,344 | 1/1994 | Jenkins | 222/504 |
| 5,467,899 | 11/1995 | Miller | 222/309 |
| 5,794,825 | 8/1998 | Gordon et al. | 222/504 |

FOREIGN PATENT DOCUMENTS

| | | |
|---|---|---|
| 0 040 068 A1 | 11/1981 | European Pat. Off. . |
| 38 41 474 A1 | 6/1990 | Germany . |
| 61-78460 | 4/1986 | Japan . |
| 5-97127 | 4/1993 | Japan . |

*Primary Examiner*—J. Casimer Jacyna
*Attorney, Agent, or Firm*—McDermott, Will & Emery

[57] ABSTRACT

There is provided a hot melt applicator including (a) a nozzle opening, (b) a valve seat disposed upstream of the nozzle opening, (c) an empty chamber formed between the nozzle opening and the valve seat, (d) a valve body movable to the valve seat so that the valve seat is open or closed, and (e) a spring for biasing the valve body; and a pneumatically driven cylinder for driving the spring. The valve body is shaped to be a cone having an apex angle facing the nozzle opening, and the valve seat is formed with a tapered surface which is to make a contact with the cone. The tapered surface has an angle greater than the apex angle of the cone, and has a length of at least 1 mm. The hot melt applicator uses a pneumatically driven cylinder for driving the valve body to thereby compress the spring which in turn compresses the valve body, and thus, avoids the great resistance of hot melt with the spring used as a large capacity. By slightly changing angles of the valve body and the valve seat, the leakage which would occur when the valve is closed is prevented. By setting a length of the taper surface of the valve seat which is to make contact with the valve body to be in the range of 1 mm to 2 mm, the present invention makes it possible to prevent making of glue filament for a glue having great viscosity such as hot melt. In addition, setting a stroke of the valve body in the range of 0.3 mm to 0.5 mm ensures more effectively to prevent making of glue filament.

7 Claims, 5 Drawing Sheets

HOT MELT APPLICATOR AND NOZZLE USED THEREFOR

This application is a divisional of U.S. application Ser. No. 08/796,705 filed Feb. 6, 1997, still pending.

BACKGROUND OF THE INVENTION

1. Field of the Invention

The present invention relates to an apparatus for applying thermoplastic hot melt glue, and more particularly to such an apparatus which is capable of preventing hot melt from roping from a nozzle when the nozzle is shut off. The present invention further relates to a nozzle through which viscous fluid such as glue, paint and sealing material is discharges and which is suitable for the above mentioned apparatus.

2. Description of the Prior Art

Boxes and bags have been conventionally made by intermittently applying a glue onto a glue margin of boxes and bags, folding the glued margins to thereby secure the margins to a predetermined areas, and thus completing boxes and bags. Glue is applied by means of a roller or a discharge nozzle. When glue is to be intermittently applied, a discharge nozzle has been widely used because of easiness of control thereof.

In the case that a discharge nozzle is to be used to intermittently discharge glue, when glue discharge is shut off, glue discharge does not stop immediately, and hence glue tends to make glue filament. In order to solve this problem, Japanese Unexamined Patent Publication No. 61-78460 has suggested the production of negative pressure in a nozzle when a applicator nozzle is shut off, to thereby prevent making of glue filament. Japanese Unexamined Patent Publications Nos. 50-122539 and 55-2474 have suggested the provision of an absorbing nozzle in a discharge nozzle to thereby absorb glue which remains nondischarged when the discharge nozzle is shut off. Japanese Unexamined Patent Publication No. 5-97127 has suggested that when a nozzle opening is shut off, a glue discharge speed is increased and glue is blown off by discharging air through an air nozzle to thereby prevent making of glue filament.

Glue is grouped into water base glue which has been generally used and is called cold glue, and thermoplastic glue which is called hot melt. With respect to general characteristics, cold glue takes time for drying until an adhesive force is generated after cold glue has been applied, whereas hot melt produces an adhesive force immediately after having been applied. Hot melt has great viscosity, and hence, when hot melt is to be applied through a nozzle, hot melt tends to make glue filament at the time a nozzle opening is shut off. The applicator disclosed in Japanese Unexamined Patent Publication No. 5-97127 is effective for cold glue to prevent making of glue filament, but could not prevent making filament of hot melt.

As mentioned earlier, hot melt produces an adhesive force immediately after having been applied. Since hot melt is in a solid condition at room temperature, hot melt is heated to thereby be liquidized for applying through a discharge nozzle. However, a part of the liquid is gasified by heating, and the thus produced gas tends to adhere to a piston of a pneumatic cylinder for driving a discharge nozzle for open and close action thereof and, after cooled, fixedly secure a piston to a cylinder.

There has been used a discharge nozzle for releasing the above mentioned hot melt gas to atmosphere to thereby prevent the gas from entering a piston. FIG. 1 illustrates an example of a discharge nozzle formed with an opening through which hot melt gas is to be released to atmosphere. A main body 1 of the illustrated discharge nozzle is partitioned into a glue chamber 3 and a cylinder 4 by a sealing section 2. There are provided a glue chamber cover 5 having a nozzle opening 9, and a glue inlet 11 in the glue chamber 3. Glue supplied through the glue inlet 11 is discharged through the nozzle opening 9. A piston 7 is slidably fit in the cylinder 4. A valve rod 8 extends passing through the sealing section 2, and has both a tip end 8*a* for opening and closing the nozzle opening 9 and a rear end at which the valve rod is connected to the piston 7. There is provided a spring 10 at the rear of the piston 7, namely at the opposite side of the valve rod 8, which spring compresses the piston 7 so that the nozzle opening 9 is closed with the tip end 8*a* of the valve rod 8. Within the cylinder 4 is provided an air supply inlet 16 at the side of the sealing section 2. Air under pressure is supplied into the glue chamber 3 through the air supply inlet 16 to move the piston to thereby separate the tip end 8*a* of the valve rod 8 from the nozzle opening 9 for discharging glue therethrough.

The sealing section 2 is formed centrally with a valve rod passage 12 through which the valve rod 8 passes, and with an atmosphere releasing passage 17 which communicates the valve rod passage 12 to atmosphere. At opposite ends of the valve rod passage 12 are provided U-shaped seals 14 for preventing glue from entering the cylinder 4 from the glue chamber 3. When the valve rod 8 makes reciprocal movement, fluid glue acting as a lubricant enters the valve rod passage 12 in a small amount and is gasified. A part of the thus produced gas is released through the atmosphere releasing passage 17.

As discussed earlier, even if a structure including two seals and an atmosphere releasing passage located intermediate between the two seals is used, gasified glue enters a cylinder during a discharge nozzle is used for long hours, and adheres to a slide surface of a piston, resulting in that a piston is fixedly adhered to a cylinder. In particular, when a discharge nozzle is to be used in horizontally lying condition or with a nozzle being upwardly directed, a piston frequently is fixedly adhered to a cylinder in a relatively short time.

SUMMARY OF THE INVENTION

In view of the above mentioned problem, it is an object of the present invention to provide an applicator which is capable of preventing hot melt from making of glue filament when a nozzle opening is shut off.

Another object of the present invention to provide a nozzle used for discharging viscous fluid therethrough which nozzle is capable of preventing viscous fluid such as gasified glue from entering a cylinder from a glue chamber.

There is provided a hot melt applicator including (a) a nozzle opening, (b) a valve seat disposed upstream of the nozzle opening, (c) an empty chamber formed between the nozzle opening and the valve seat, (d) a valve body movable to the valve seat so that the valve seat is open or closed, (e) a spring for biasing the valve body, and (f) a pneumatically driven cylinder for driving the spring. The valve body is shaped to be a cone having an apex angle facing the nozzle opening, and the valve seat is formed with a tapered surface which is to make a contact with the cone, the tapered surface having an angle greater than the apex angle of the cone. The tapered surface has a length of at least 1 mm. The length of the tapered surface is preferable is equal to or shorter than 2 mm.

The valve body is driven by the spring to thereby move towards a closed position, and is driven by the pneumatically driven. cylinder for overcoming a force exerted by the spring to thereby move towards an open position. Since hot melt has great viscosity, it is necessary to provide a spring for generating a great force for closing the valve body. In order to compress the spring, there is used a pneumatically driven cylinder which is capable of producing a great force in spite of a small volume.

As a cone constituting the valve body moves to the valve seat having a tapered surface which is to be in contact with the cone when a valve is to be closed, a gap between a tapered surface of the cone and the tapered surface of the valve seat is gradually decreased, and in the long run the tapered surface makes contact with the tapered surface of the valve seat. A minority of hot melt filled in the above mentioned gap escapes in a direction opposite to a direction in which the valve body is closed, whereas a majority of hot melt is compressed in a direction in which the valve body is closed. As a result, a pressure in the empty chamber formed between the valve body and the nozzle opening is increased, thereby a discharge speed of hot melt to be discharged through the nozzle opening is increased. If the valve body is designed to have the tapered surface which is 1 mm long or longer, the increased discharge speed is significantly effective for prevention of making of glue filament of hot melt, but if the tapered surface is shorter than 1 mm, it is impossible to prevent hot melt from making of glue filament. A longer tapered surface of the valve seat is more effective for prevention of hot melt from making of glue filament. However, an upper limit of the tapered surface length is 2 mm, because fabrication cost of the valve seat is significantly increased for a tapered surface longer than 2 mm. In addition, by setting an angle of the tapered surface of the valve seat to be greater than an apex angle of the cone, it is ensured that the cone surely makes contact with the valve seat when the valve body is closed, to thereby be able to prevent leakage of hot melt. It is certainly possible to prevent making of glue filament of hot melt by adopting a spring which compresses the valve body with a great force and which can be used because of adoption of a pneumatically driven cylinder, and by setting a appropriate length for the tapered surface of the valve seat.

In a preferred embodiment, a stroke of the valve body between open and closed positions thereof is in the range of 0.3 mm and 0.5 mm.

If a stroke of the valve body between open and closed positions (hereinafter, referred to as "the stroke") is small, an increment in the discharge speed of hot melt, which is caused by narrowing a gap between the tapered surfaces of the cone and the valve seat when the valve body is to be closed, is also small. By setting the stroke to be 0.3 mm or longer, it is possible to prevent hot melt from making of glue filament. On the other hand, if the stroke is too long, it takes much time for the valve to be closed. Thus, an upper limit of the stroke is set to be 0.5 mm.

There is further provided a nozzle used for discharging viscous fluid therethrough, including (a) a glue chamber having a nozzle opening, (b) a valve rod disposed in the glue chamber and having a tip end for opening and closing the nozzle opening, (c) a cylinder in which a piston connected to a rear end of the valve rod slide, (d) a pressurized air source for supplying pressurized air to the cylinder, and (e) a seal section disposed between the glue chamber and the cylinder and formed with a passage through which the valve rod moves. The seal section prevents communication between the glue chamber and the cylinder, and includes a gas flow passage through which gas is supplied to and discharged from the passage; and a gas supplier for supplying gas to the gas flow passage.

Between the glue chamber and the cylinder is provided the sealing section, which is formed with the passage through which the valve rod extends. In order to seal a gap between the passage and the valve rod, the sealing section is provided at opposite ends thereof with seals. In addition, there is provided the gas flow passage through which gas is supplied to and discharged from the passage. Gas is supplied to the gas flow passage from the gas source, and is and discharged from the gas flow passage. Thus, even if viscous fluid gasified in the glue chamber passes through the seals disposed between the sealing section and the valve rod and enters the passage, the gasified viscous fluid is blown off to atmosphere by gas flowing through the passage. Thus, it is possible to prevent gasified viscous fluid from entering the cylinder.

In a preferred embodiment, the gas supplier includes a exhaust gas pipe through which exhaust gas is supplied from the cylinder.

Air under pressure supplied into the cylinder moves the piston, and thereafter, is discharged. By introducing the thus generated exhaust air into the gas flow passage, the gas originated from viscous fluid is released into atmosphere from the passage. Though the exhaust gas is intermittently supplied from the cylinder, the exhaust gas can sufficiently release the gas to atmosphere, because only a small amount of gas originated from viscous fluid enters the passage.

In a still preferred embodiment, the exhaust gas pipe is formed with a branch pipe through which a part of exhaust gas is released to atmosphere.

By forming the exhaust gas pipe with the branch pipe to thereby release a part of the exhaust gas to atmosphere, it is possible to reduce a back pressure of the cylinder for smooth movement of the piston.

In a yet preferred embodiment, hot melt is supplied to the glue chamber.

When heated, hot melt is liquidized, and a part of the thus produced liquid is gasified. Even if the thus produced gas enters the passage through which the valve rod extends, the gasified glue is released to atmosphere by gas supplied to the gas flow passage, and thus cannot enter the cylinder.

In a still yet preferred embodiment, there is provided a variable restriction between the gas flow passage and a gas source.

In a further preferred embodiment, the nozzle further includes a variable restriction in the branch pipe.

In a further preferred embodiment, the nozzle further includes a silencer in the branch pipe.

The advantages obtained by the aforementioned present invention will be described hereinbelow.

A hot melt applicator in accordance with the present invention uses a pneumatically driven cylinder for driving the valve body to thereby compress the spring which in turn compresses the valve body, and thus, avoids the great resistance of hot melt with the spring used as a large capacity. By slightly changing angles of the valve body and the valve seat, the leakage which would occur when the valve is closed is prevented. By setting a length of the taper surface of the valve seat which is to make contact with the valve body to be in the range of 1 mm to 2 mm, the present invention makes it possible to prevent making of glue filament for a glue having great viscosity such as hot melt. In addition, setting a stroke of the valve body in the range of 0.3 mm to 0.5 mm ensures more effectively to prevent making of glue filament.

A nozzle used for discharging viscous fluid therethrough makes it possible to certainly prevent gasified viscous fluid from passing through the valve rod passage from the glue chamber and entering the cylinder by supplying air to and discharging air from the valve rod passage of the sealing section formed between the glue chamber and the cylinder. In order to prevent gasified viscous fluid from entering the cylinder, exhaust gas from the cylinder may be supplied to the valve rod passage in place of pressurized air. Thus, it is possible to have a longer interval for disassembling, checking and cleaning.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

Preferred embodiments in accordance with the present invention will be explained hereinbelow with reference to drawings.

Figure 1:
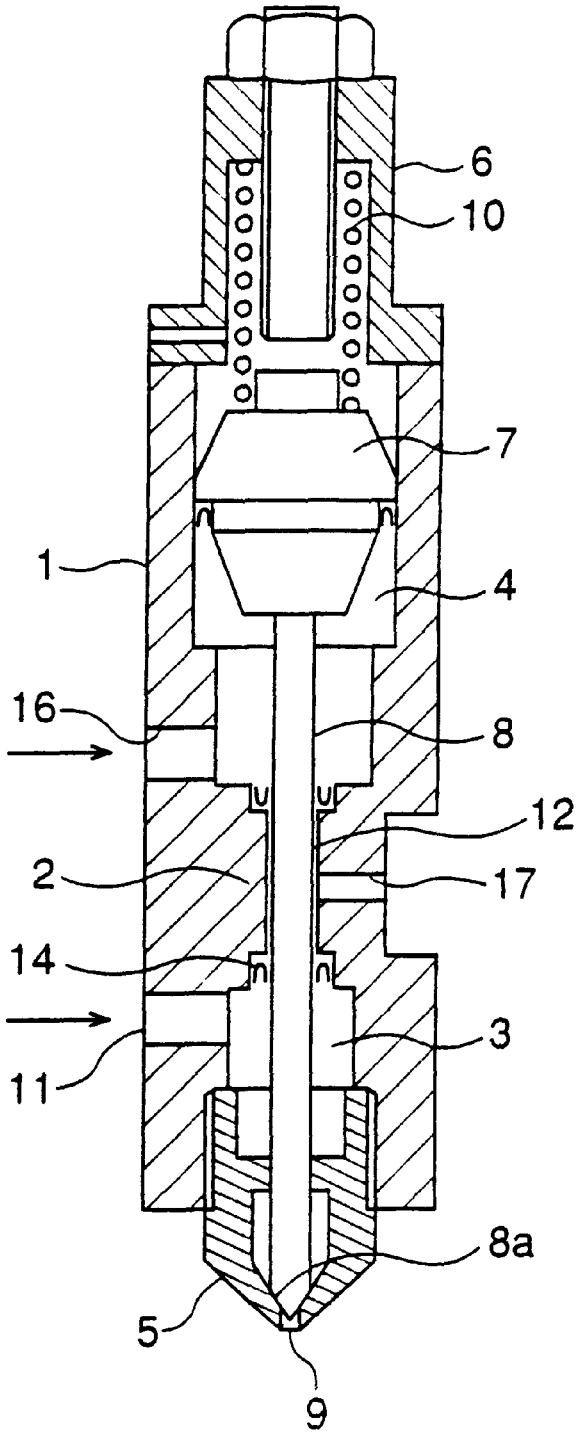
FIG.1 PRIOR ART
FIG. 1 is a view illustrating a structure of a conventional nozzle for discharging glue therethrough.
Figure 2:
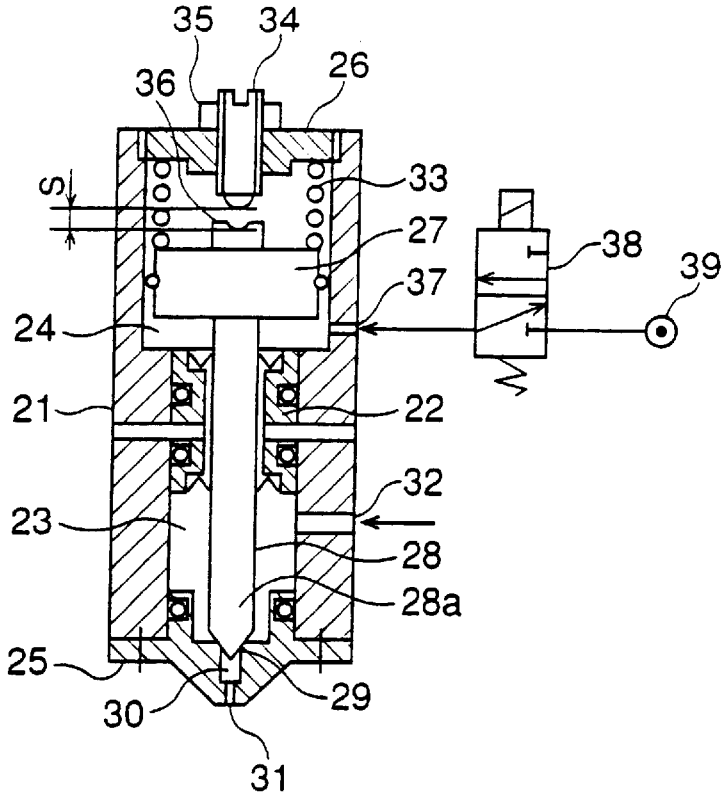
FIG. 2 is a cross-sectional view of a structure of the first embodiment in accordance with present invention.

FIG. 2 is a cross-sectional view illustrating a hot melt applicator made in accordance with the first embodiment. A main body 21 of the applicator is cylindrical in shape, and has two different inner diameters varying at a center of the main body: an upper part of the main body makes a cylinder 24 and a lower part makes a glue chamber 23 in FIG. 2. A partition seal 22 is provided within the stepped glue chamber 23 to thereby separate the glue chamber 23 and the cylinder 24 from each other for prevention of air leakage from the cylinder 24 to the glue chamber 23. A glue chamber cover 25 having a valve seat 29 and a nozzle opening 31 is secured to the main body 21 by means of bolts at an end of the glue chamber 23. A cylinder cover 26 is threaded into and thus fixed to the cylinder 24 at its end.

In the cylinder is provided a piston 27 which is connected to a needle valve 28 passing through the partition seal 22 and the glue chamber 23 and. reaching the glue chamber cover 25. A valve body 28*a* formed at a tip end of the needle valve 28 is a cone in shape, and is to make contact with a valve seat 29 formed at the glue chamber cover 25 and having a conically shaped tapered surface, to thereby carry out valve function. The valve seat 29 is in. communication with a cylindrical empty chamber 30. A nozzle opening 31 is formed at an end of the empty chamber 30. The glue chamber 23 is formed with an glue inlet 32 through which hot melt is supplied from a device (not illustrated). Since hot melt is solidified at room temperature, hot melt is heated to thereby be liquidized when applied, and the thus liquidized hot melt is supplied through a pump.

There is provided a spring 33 between the piston 27 and the cylinder cover 26 for compressing the piston 27 to thereby compress the needle valve 28 onto the valve seat 29 to shut off the valve. The cylinder cover 26 is formed with a stroke adjusting screw 34 which is fixed to a position adjusted by a nut 35. There is provided a screw receiver 36 in facing relation to the stroke adjusting screw 34 of the piston 27. A gap between the screw receiver 36 and the stroke adjusting screw 34 with the piston 27 being compressed by the spring 33 to thereby cause the needle valve 28 to be compressed onto the valve seat 29 make a stroke of the needle valve 28. Within the cylinder is provided an air passage 37 at the side of the partition seal 22. Air under pressure is supplied to and discharged from the cylinder 24 through the air passage 37. The air passage 37 is in communication with an electromagnetic directional control valve 38 which is operated with control signals transmitted from a controller (not illustrated). The electromagnetic directional control valve 38 is in communication with an air source 39 from which air under pressure is supplied.

Figure 3:
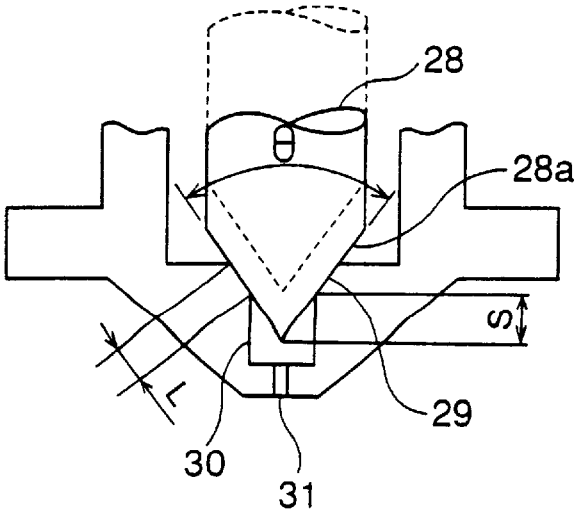
FIG. 3 is a detailed view of a valve body, a valve seat and a nozzle opening in the first embodiment.

FIG. 3 illustrates an arrangement of the needle valve and the valve seat. The valve body 28*a* of the needle valve 28 is conical in shape, and has an apex angle θ of 59 degrees. The apex angle θ is preferably about 60 degrees for prevention of roping of hot melt and also for processability. The valve seat 29 includes a conical tapered surface having an apex angle of 60 degrees which is 1 degree greater than the apex angle of the valve body 28*a*. Thus, the valve body 28*a* can certainly sit on the valve seat 29 to thereby prevent leakage of hot melt. The tapered surface of the valve seat 29 has a length L in the range of 1 mm to 2 mm. The valve body 28*a* is influenced by the spring 33 and air under pressure to thereby move between positions indicated with solid and broken lines, and thus makes open and close movement. When the valve body 28*a* is compressed, a minority of hot melt present between the tapered surfaces of the valve seat 29 and the valve body 28*a* indicated with a broken line is forced to return to the glue chamber 23, whereas a majority of hot melt is forced to be discharged through the nozzle opening 31 in an increased speed. Since hot melt is incompressible and highly viscous liquid and the glue chamber 23 is filled with hot melt, when the valve body 28*a* is compressed to thereby move, only a part of hot melt is returned to the glue chamber 23 and most of hot melt is forced to move into the empty chamber 30.

The length L of the tapered surface of the valve seat 29 significantly influences on the discharge speed of hot melt when the valve is closed. If the length L is smaller than 1 mm, making of glue filament of hot melt can scarcely be prevented, whereas if the length L is equal to or longer than 1 mm, making of glue filament of hot melt can be prevented almost without failure. By setting the length L longer and longer, it would be possible to prevent making of glue filament of hot melt, but the cost for fabrication of the valve seat 29 would also be increased. Hence, an upper limit of the length L is about 2 mm.

The stroke of the needle valve 28 is set in the range of 0.3 mm to 0.5 mm by means of the stroke adjusting screw 34. If the stroke is set small, an amount of hot melt discharged into the empty chamber 30 by the valve body 28*a* is not sufficient when the valve is closed, resulting in that an increment in the discharge speed is small and that making of glue filament of hot melt cannot be sufficiently prevented. If the stroke is set to be 0.3 mm or longer, it is possible to substantially certainly prevent hot melt from making of glue filament The longer stroke would ensure a greater increment in the discharge speed of hot melt. However, it is no longer necessary to increase the discharge speed of hot melt any more, if hot melt does no longer make glue filament. Since the longer stroke would make a time for closing the valve longer, an upper limit of the stroke is 0.5 mm.

Figure 4:
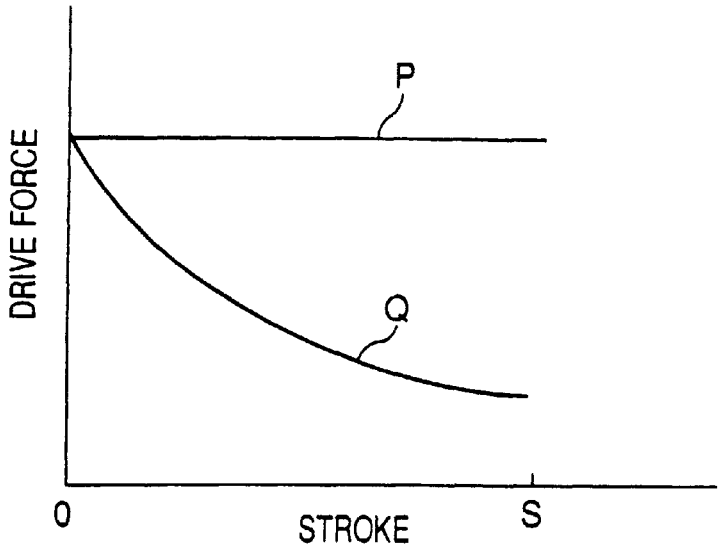
FIG. 4 is a view showing drive forces of a pneumatically driven cylinder and an electromagnetic driving means.

FIG. 4 shows comparison in a driving force between a pneumatically driven cylinder and an electromagnetically driving means including a solenoid. An axis of abscissa indicates a stroke S of the needle valve, and an axis of ordinate indicates a force to be produced. A force P produced by a pneumatically driven cylinder is uniform to the stroke S, whereas a force Q produced by the electromagnetic driving means including a solenoid rapidly decreases with an increase of the stroke S. Since hot melt has great viscosity, the needle valve 28 receives great resistance when closed with the result that the spring 33 compresses with greater resilient force. For the above mentioned reason, a pneumatically driven cylinder which is capable of continuously producing great force is suitable as a means for compressing the spring 33.

Figure 5:
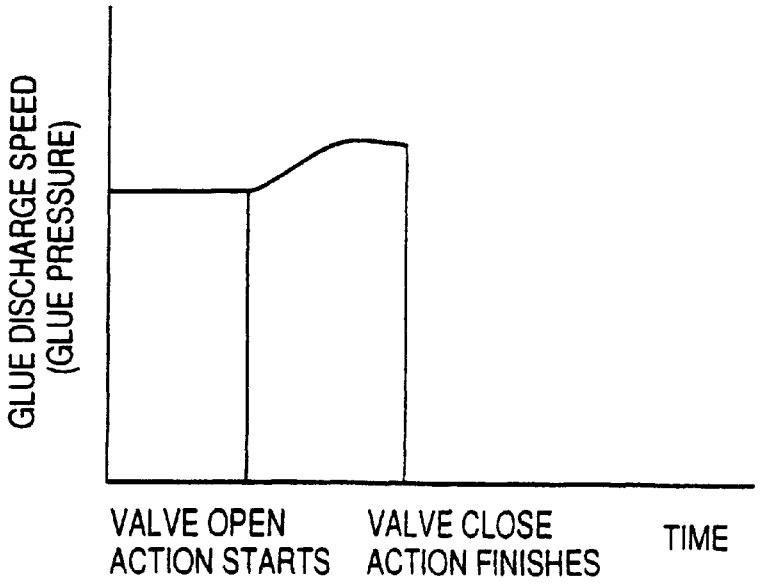
FIG. 5 is a view showing discharge speed of hot melt discharged through a nozzle of the embodiment.

Hereinbelow is explained the performance of the hot melt applicator having the above mentioned structure. FIG. 5 shows the discharge speed of hot melt to be discharged through the nozzle opening 31. An axis of abscissa indicates time, and an axis of ordinate indicates a discharge speed of hot melt to be discharged through the nozzle opening 31. That is, an axis of ordinate indicates a pressure in the empty chamber 30. If the valve starts its close action, the discharge speed increases, and the discharge speed at the time when the valve is fully closed is greater than the normal discharge speed. Thus, it is possible to prevent hot melt from making of glue filament when the valve is closed. FIG. 5 is the same as FIG. 8 of Japanese Unexamined Patent Publication No. 5-97127 which relates to cold glue, but shows that the present invention can prevent making of glue filament of hot melt as well as cold glue.

Hereinbelow, the second and third embodiments in accordance with the present invention will be explained with reference to drawings. In the later mentioned embodiment, glue is exemplified as viscous fluid, however, paint or sealing material may be exemplified in place of glue. In addition, hereinbelow will be explained the operation when hot melt is used as glue. The operation when cold glue or others is used as glue is almost common.

Figure 6:
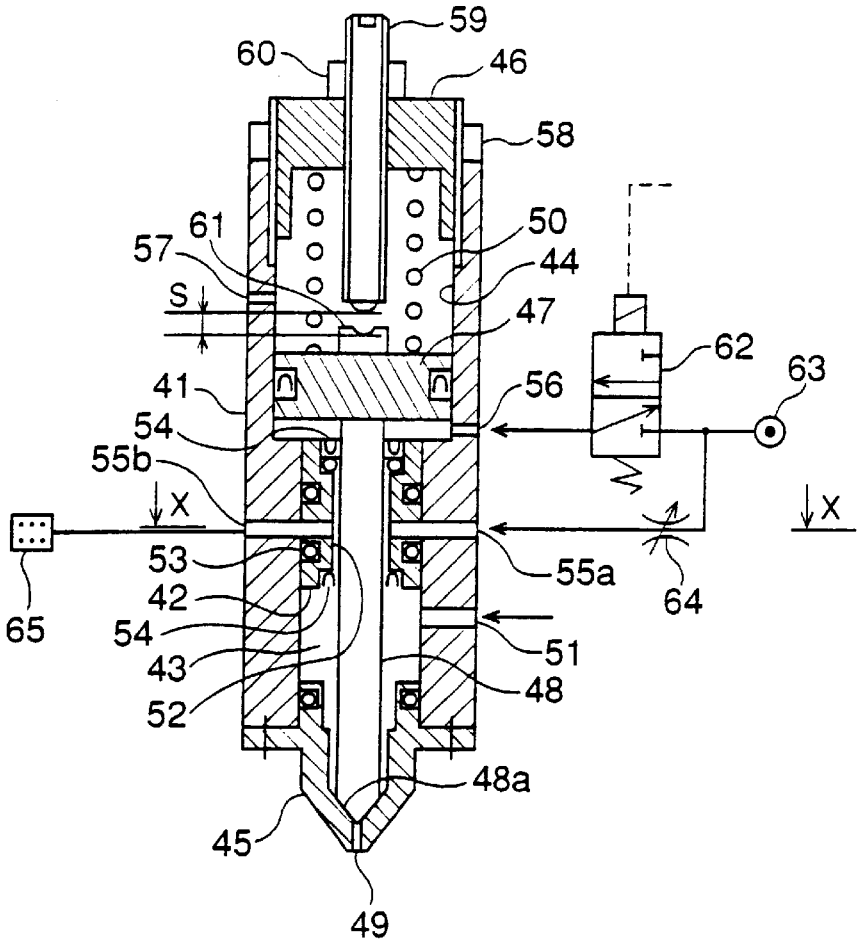
FIG. 6 is a view of a structure of the second embodiment in accordance with the present invention.
Figure 7:
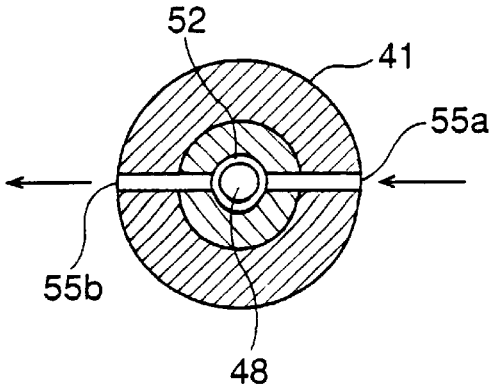
FIG. 7 is as cross-sectional view taken along the line X—X in FIG. 6.

FIG. 6 illustrates a structure of a nozzle to be used for discharging glue therethrough, made in accordance with the second embodiment of the present invention. FIG. 7 is a cross-sectional view taken along the line X—X in FIG. 6. A main body 41 of a nozzle used for discharging glue therethrough is internally cylindrical in shape, and has two different inner diameters varying at a center of the main body: an upper part of the main body makes a cylinder 44 and a lower part makes a glue chamber 43 in FIG. 6. Within the glue chamber having a smaller diameter is provided a cylindrically shaped sealing section 42 which partitions the glue chamber 43 from the cylinder 44. A glue chamber cover 45 having a nozzle opening 49 is secured to the main body 41 by means of bolts at an end of the glue chamber 43. The glue chamber 43 is to preserve paint if paint is to be used in place of glue, or preserve sealing material if sealing material is to be used in place of glue.

A cylinder cover 46 is threaded into the main body 41 at an end of the cylinder 44. Within the cylinder 44 is provided a piston 47 to which a valve rod, 48 is fixedly secured. The valve rod 48 has a tip end 48*a* which extends passing through the glue chamber 43 and reaches the nozzle opening 49 formed at the glue chamber cover 45. The sealing section 42 is formed at an outer periphery thereof with O-rings 53 for sealing, and formed centrally with a valve rod passage 52 through which the valve rod 48 extends. There are provided gas supply opening 55*a* and gas exhaust opening 55*b* both passing through the main body 41 and the sealing section 42 and reaching the valve rod passages 52. Gas are supplied to the valve rod passage 52 through the gas supply opening 55*a* and is discharged from the valve rod passage 52 through the gas exhaust opening 55*b*. At the opposite ends of the valve rod passage 52 of the sealing section 42 are provided with U-shaped seals 54 for sealing a gap formed between the sealing section 42 and the valve rod 48. The sealing section 42 is provided with the O-rings in order to enhance the non-communication effect to the cylinder 44. The U-shaped seals and O-rings cooperate with each other to prevent both the glue chamber 43 and the cylinder 44 from getting in communication with the valve rod passage 52.

The glue chamber 43 is formed with a glue inlet 51. Glue is supplied into the glue chamber through the glue inlet 51 from a glue supplier (not illustrated), and is discharged through the nozzle opening 49. There is provided a spring 50 between the cylinder cover 46 and the piston 47, which spring 50 compresses the piston 47 to thereby cause the tip end 48*a* of the valve rod 48 to close the nozzle opening 49. A strength of the spring 50 is able to be adjusted by rotating the cylinder cover 46. When the cylinder cover 46 reaches an appropriate position, the cylinder cover 46 is fixed at the position by a fixture nut 58. The cylinder 44 is formed in the vicinity of the sealing section 42 with an air supply and exhaust opening 56 through which air under pressure is supplied and discharged, and also formed closer to the cylinder cover 46 with a release opening 57 through which the cylinder 44 is released to atmosphere. The cylinder cover 46 is formed with an adjust screw 59 for adjusting a stroke of the piston 47, and with a fixture nut 60 for fixing the adjust screw 59. The piston 47 is formed with a screw receiver 61 in facing relation to the adjust screw 59. A space S between the adjust screw 59 and the screw receiver 61 makes a stroke of the piston 57.

The air supply and exhaust opening 56 formed with the cylinder 44 is in communication with an electromagnetic directional control valve 62 which operates based on control signals transmitted from a controller (not illustrated). The electromagnetic directional control valve 62 is in communication with an air source 63 which supplies air under pressure. The gas supply opening 55*a* is in communication with the air source 63 through a variable restriction 64, and thus pressurized air having a predetermined pressure is supplied to the gas supply opening 55*a*. The gas exhaust opening 55*b* is released to atmosphere, and, if necessary, is in communication with a silencer 65 for noise elimination. When the silencer 65 is not provided, an opening end is downwardly directed to thereby prevent dust from entering the gas exhaust opening 55*b*.

Hereinbelow is explained the operation. Hot melt is used as glue. Since hot melt is in a solid condition at room temperature, when applied, hot melt is heated to thereby be liquidized. The liquidized hot melt is supplied into the glue chamber 43 through the glue inlet 51 by means of a pump. When the electromagnetic directional control valve 62 is at a closed position, the air source 63 is in communication with the air supply and exhaust opening 56, whereas the electromagnetic directional control valve 62 is at an open position, the air supply and exhaust opening 56 is released to atmosphere. When the electromagnetic directional control valve 62 is at an open position, the air under pressure is not supplied to the cylinder 44. As a result, the piston 47 is compressed by the spring 50, and thus the tip end 48*a* of the valve rod 48 shuts off the nozzle opening 49 with the result that glue is not discharged. When the electromagnetic directional control valve 62 is at a closed position, the air under pressure is supplied to the cylinder 44. Hence, the piston 47 is lifted up and accordingly the tip end 48*a* of the valve rod 48 leaves away from the nozzle opening 49 with the result that glue is discharged. The air under pressure is supplied to the air supply opening 55*a* from the air source 63 through the variable restriction 64, and purges the valve rod passage 52 and is released to atmosphere through the air exhaust opening 55*b*. Thus, even if gasified glue in the glue chamber 43 passes through the U-shaped seals 54 and enter the valve rod passage 52, the gasified glue is purged. Thus, gasified glue does never pass through the O-rings 53 and U-shaped seals 54 both disposed in the sealing section 42 and enter the cylinder 44. The foregoing description concerns hot melt having a high temperature. In cold glue which is to be used at room temperature, even if the glue is gasified, a temperature of the gas is low and vapor pressure of the gas is low. Hence, since the gas is exhausted through the air exhaust opening 55*b*, the gasified glue never enters the cylinder 44. When cold glue is used, it is not necessary to supply air to the air supply opening 55*a*.

Figure 8:
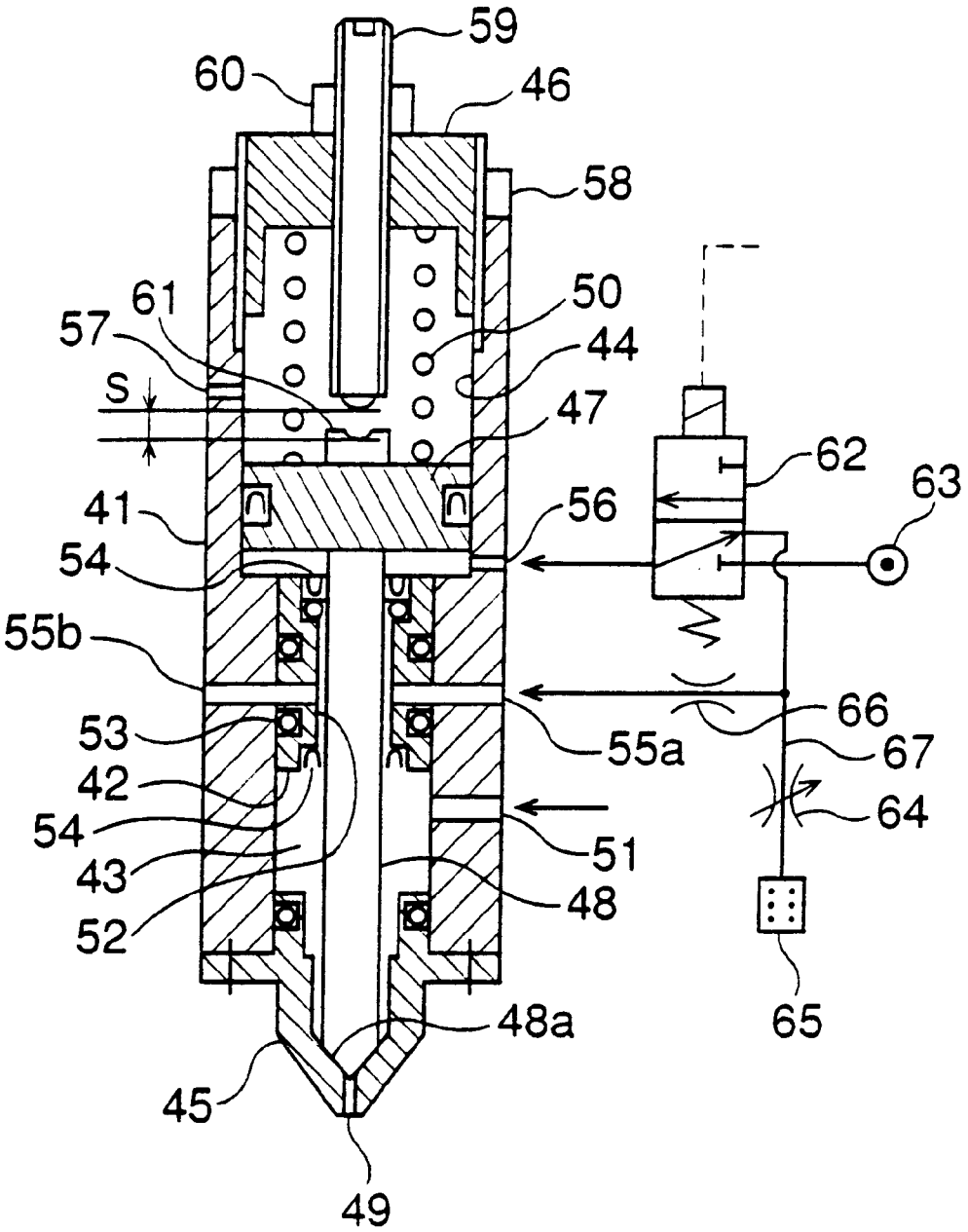
FIG. 8 is a view of a structure of the third embodiment in accordance with the present invention.

Next will be explained the third embodiment. FIG. 8 illustrates a structure of the third embodiment. The same reference numerals as those of FIGS. 6 and 7 indicate the same elements. Air supply to the air supply opening 55*a* is made from the air source 63 in the second embodiment, whereas exhaust gas from the cylinder 44 is supplied to the air supply opening in the third embodiment. To this end, an atmosphere release port of the electromagnetic directional control valve 62 is in communication with the air supply opening 55*a*. A fixed restriction 66 may be provided on the way to the air supply opening 55*a*. Since a back pressure of the cylinder 44 will become great, a branch line 67 may be provided to thereby release a part of the exhaust gas to atmosphere. Such an arrangement makes it possible to rapidly close the nozzle opening 49 to thereby prevent discharge glue from making filament at an end thereof. There are provided the variable restriction 64 and the silencer 65 in order to provide a resistor to the branch line 67. The other structure than the above mentioned is the same as the first embodiment.

In the third embodiment, air supply to the air supply opening 55*a* is intermittently made in accordance with the operation of the electromagnetic directional control valve 62. However, since only a small amount of gasified glue enters the valve rod passage 52, it is sufficiently possible to release the gasified glue to atmosphere even by intermittent purge.

In the above mentioned embodiments, air is supplied to the air supply opening 55*a*, but other gases, for instance, stable gases such as nitrogen may be used instead. In addition, although the piston 47 is driven by the spring 50 and pressurized air in the above mentioned embodiments, the piston may be driven only by pressurized air or by a solenoid.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A nozzle used for discharging viscous fluid therethrough, comprising:

(a) a glue chamber having a nozzle opening;

(b) a valve rod disposed in said glue chamber and having a tip end for opening and closing said nozzle opening;

(c) a cylinder in which a piston connected to a rear end of said valve rod slide;

(d) a pressurized air source for supplying pressurized air to said cylinder; and (e) a seal section disposed between said glue chamber and said cylinder and formed with a valve rod passage through which said valve rod moves, said seal section preventing communication between said glue chamber and said cylinder, said seal section including a gas flow passage through which gas is supplied to and discharged from said valve rod passage; and a gas supplier for supplying gas to said gas flow passage.

2. The nozzle as set forth in claim 1, wherein hot melt is supplied to said glue chamber.

3. A nozzle used for discharging viscous fluid therethrough, comprising:

(a) a glue chamber having a nozzle opening;

(b) a valve rod disposed in said glue chamber and having a tip end for opening and closing said nozzle opening;

(c) a cylinder in which a piston connected to a rear end of said valve rod slide;

(d) a pressurized air source for supplying pressurized air to said cylinder; and (e) a seal section disposed between said glue chamber and said cylinder and formed with a passage through which said valve rod moves, said seal section preventing communication between said glue chamber and said cylinder, said seal section including a gas flow passage through which gas is supplied to and discharged from said passage; and a gas supplier for supplying gas to said gas flow passage, wherein said gas supplier comprises an exhaust gas pipe through which exhaust gas is supplied from said cylinder.

4. The nozzle as set forth in claim 3, wherein said exhaust gas pipe is formed with a branch pipe through which a part of exhaust gas is released to atmosphere.

5. The nozzle as set forth in claim 4 further comprising a variable restriction in said branch pipe.

6. The nozzle as set forth in claim 4 further comprising a silencer in said branch pipe.

7. A nozzle used for discharging viscous fluid therethrough, comprising:

(a) a glue chamber having a nozzle opening;

(b) a valve rod disposed in said glue chamber and having a tip end for opening and closing said nozzle opening;

(c) a cylinder in which a piston connected to a rear end of said valve rod slide;

(d) a pressurized air source for supplying pressurized air to said cylinder; and (e) a seal section disposed between said glue chamber and said cylinder and formed with a passage through which said valve rod moves, said seal section preventing communication between said glue chamber and said cylinder, said seal section including a gas flow passage through which gas is supplied to and discharged from said passage; and a gas supplier for supplying gas to said gas flow passage;

wherein there is provided a variable restriction between said gas flow passage and a gas source.

* * * * *